US010112286B2

(12) United States Patent
Lin

(10) Patent No.: US 10,112,286 B2
(45) Date of Patent: Oct. 30, 2018

(54) KNIFE SHARPENING SHEATH AND METHOD FOR MAKING THE SAME

(71) Applicant: LIFETIME BRANDS, INC., Garden City, NY (US)

(72) Inventor: Hsin-Jung Lin, Forest Hills, NY (US)

(73) Assignee: LIFETIME BRANDS, INC., Garden Ctiy, NY (US)

( * ) Notice: Subject to any disclaimer, the term of this patent is extended or adjusted under 35 U.S.C. 154(b) by 81 days.

(21) Appl. No.: 15/051,071

(22) Filed: Feb. 23, 2016

(65) Prior Publication Data

US 2016/0243674 A1 Aug. 25, 2016

Related U.S. Application Data

(60) Provisional application No. 62/120,483, filed on Feb. 25, 2015.

(51) Int. Cl.
*B24D 15/08* (2006.01)

(52) U.S. Cl.
CPC ..... *B24D 15/084* (2013.01)

(58) Field of Classification Search
CPC ..... B24D 15/084
See application file for complete search history.

(56) References Cited

U.S. PATENT DOCUMENTS 4,117,748 A * 10/1978 Watts ..... B24D 15/084 76/86
4,805,350 A * 2/1989 Farrer ..... B24D 15/084 30/138
5,009,040 A * 4/1991 Petroff ..... B24D 15/084 30/138
5,784,786 A * 7/1998 Williams ..... B26B 29/025 30/138
6,117,002 A * 9/2000 Stokes ..... B24D 15/084 30/138
6,224,475 B1 * 5/2001 May ..... B24D 15/084 30/298.4
7,469,475 B2 * 12/2008 Wong ..... B01J 2/20 30/151
D591,040 S * 4/2009 Foster ..... D3/220
2014/0137474 A1 5/2014 Murphy et al.
2015/0031274 A1 * 1/2015 Beechinor ..... B24D 15/084 451/553

FOREIGN PATENT DOCUMENTS

GB 2 369 595 A 6/2002
GB 2369595 A * 6/2002 ..... B24D 15/084

OTHER PUBLICATIONS

International Search Report and Written Opinion issued in International Application No. PCT/US16/19123 dated Apr. 29, 2016.

* cited by examiner

*Primary Examiner* — Marc Carlson
(74) *Attorney, Agent, or Firm* — Tutunjian & Bitetto, P.C.

(57) ABSTRACT

A knife sharpening sheath has an open end for receiving a knife, and which open end also includes provision for receiving and securing a knife sharpening cartridge. The sheath includes openings in opposing sides and the knife sharpening cartridge includes rearwardly extending legs configured to be received by, and secured into said openings in the opposing sides.

10 Claims, 7 Drawing Sheets

KNIFE SHARPENING SHEATH AND METHOD FOR MAKING THE SAME

CROSS REFERENCE TO RELATED APPLICATIONS

This application claims priority from U.S. Provisional Application Ser. No. 62/120,483, filed Feb. 25, 2015.

BACKGROUND

1. Field of the Invention

The present invention relates to knife sharpeners. More particularly it relates to a knife sharpening knife sheath and method of making the same using a knife sharpening cartridge.

2. Discussion of Related Art

Knife sharpeners are commonplace in a professional or even in a cooking enthusiast's kitchen. These professionals/enthusiasts also appreciate that the proper sharpening of a knife is integral in the knife's operation for its intended purpose. For the amateur, knife sharpeners are not as commonly used, and even if they are, more times than not, the amateur will not have sufficient knowledge as to how to properly sharpen the respective knife. This proper sharpening is related to the angle at which the sharp edge of the knife blade contacts the sharpening during the entire sharpening motion. As such, the amateur will often cause more damage to the knife than good in their attempt to sharpen the same.

There are various knife sharpeners that seek to that include some form of fixed angular surface so as to prevent the damaging of knives during the sharpening process, particularly when done by an amateur. One form of such sharpeners is the integration of the same into a knife sheath. In this manner, the position of the blade with respect to the angular surface of the knife sharpening integrated into the sheath remains fixed, and the amateur user no longer has to worry about damaging the sharp knife edge due to their inexperience.

One major drawback to knife sharpeners integrated into a knife sheath is that they are very difficult and expensive to manufacture. In addition, over time the knife sharpening wears down, and does not provide the desired sharpening effect. In addition, as they wear down, they can actually cause more damage than good the sharp knife edge.

It would therefore be advantageous to manufacture a knife sheath using a knife sharpening cartridge so as to reduce the manufacturing costs and time in making the same.

SUMMARY

According to an implementation, the knife sheath includes a body having opposing sides, a closed distal end and an open proximal end. A knife receiving slot is accessible from the open proximal end and is configured to receive and secure a knife. A knife sharpener receiving slot is disposed within the open proximal end of the body at a base thereof. A knife sharpening cartridge has sharpening elements and is configured to be received into the knife sharpener receiving slot such that sharpening elements are in communication the knife receiving slot.

According to another implementation, the sheath includes a knife receiving slot accessible from an open proximal end and being configured to receive and secure a knife. A knife sharpener receiving slot is disposed within the open proximal end at a base thereof, and a knife sharpening cartridge having sharpening elements is configured to be received into the knife sharpener receiving slot such that sharpening elements are in communication the knife receiving slot.

These and other aspects, features and advantages of the present principles will become apparent from the following detailed description of exemplary embodiments, which is to be read in connection with the accompanying drawings.

BRIEF DESCRIPTION OF THE DRAWINGS

The present principles may be better understood in accordance with the following exemplary figures, in which.

DETAILED DESCRIPTION

The present description illustrates the present principles. It will thus be appreciated that those skilled in the art will be able to devise various arrangements that, although not explicitly described or shown herein, embody the present principles and are included within its spirit and scope.

All examples and conditional language recited herein are intended for pedagogical purposes to aid the reader in understanding the present principles and the concepts contributed by the inventor(s) to furthering the art, and are to be construed as being without limitation to such specifically recited examples and conditions.

Moreover, all statements herein reciting principles, aspects, and embodiments of the present principles, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Figure 1:
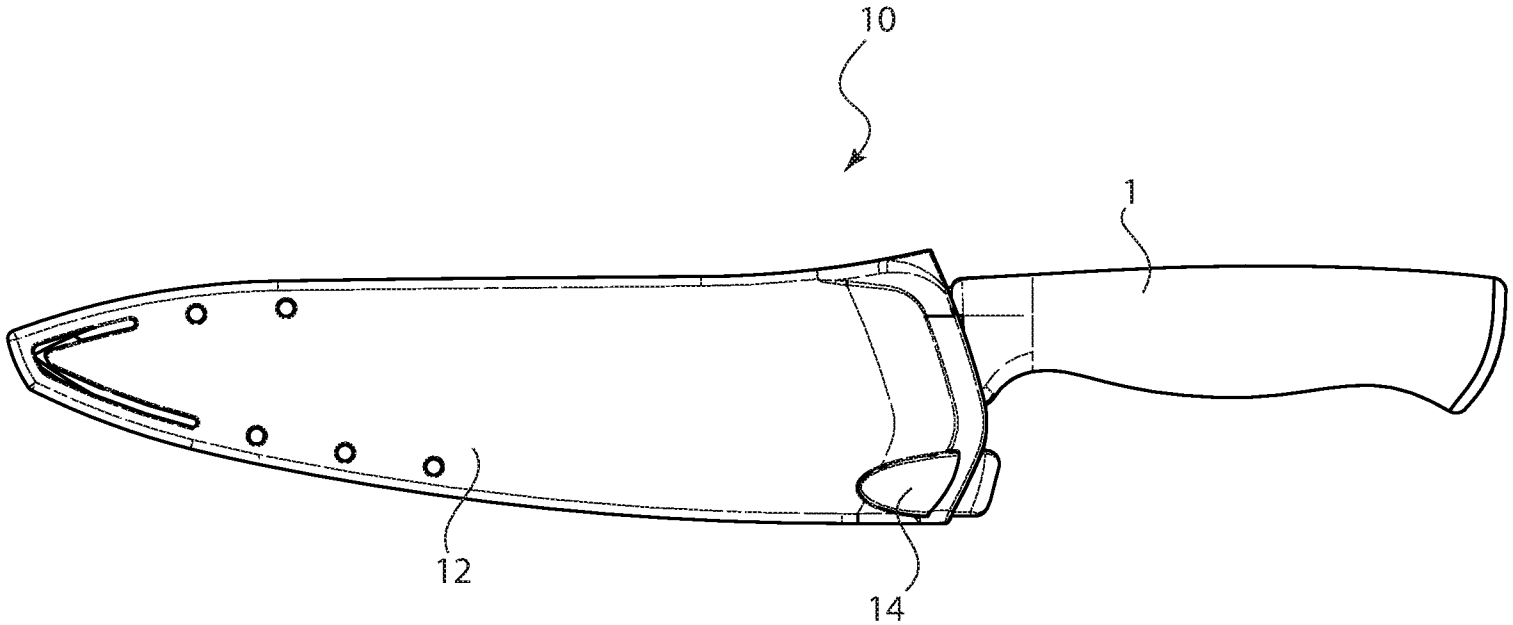
FIG. 1 is a side view of a knife sheath with knife sharpening cartridge having a knife positioned therein, according to an implementation of the present principles.
Figure 2:
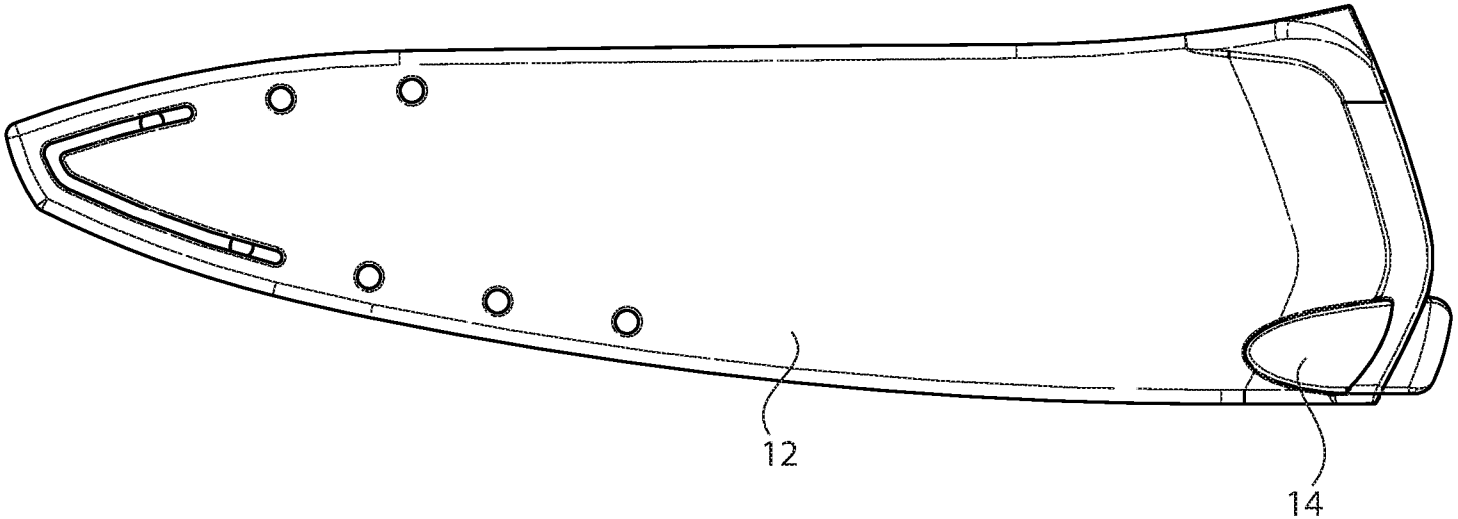
FIG. 2 is a side view of knife sheath with knife sharpening cartridge, according to an implementation of the present principles.
Figure 3:
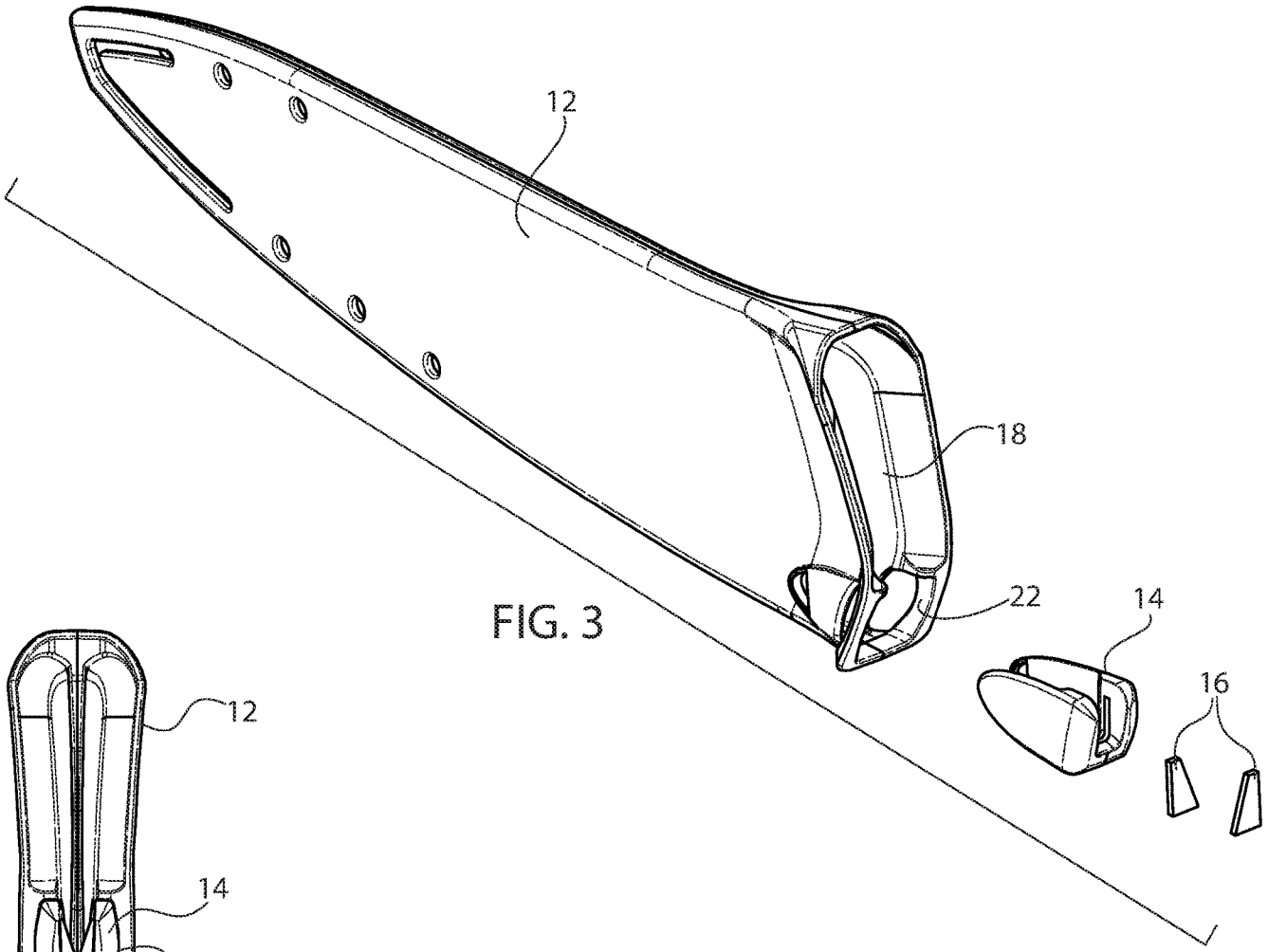
FIG. 3 is an exploded perspective view of the knife sheath with knife sharpening cartridge, according to an implementation of the present principles.
Figure 4:
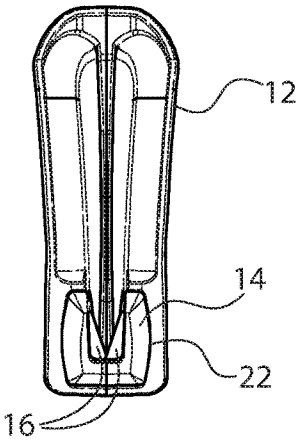
FIG. 4 is an end view of the knife sheath with knife sharpening cartridge, according to an implementation of the present principles.
Figure 5:
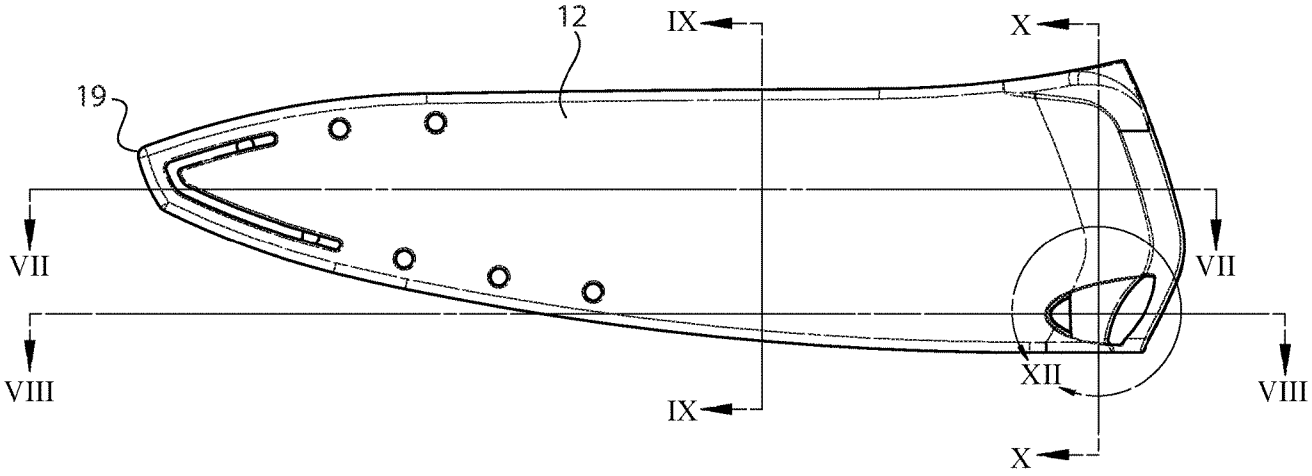
FIG. 5 is a side view of the knife sheath without the knife sharpening cartridge disposed therein, according to an implementation of the present principles.
Figure 6:
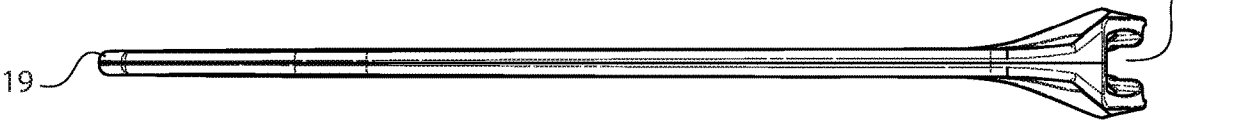
FIG. 6 is a top view of the knife sheath of FIG. 5, according to an implementation of the present principles.
Figure 7:
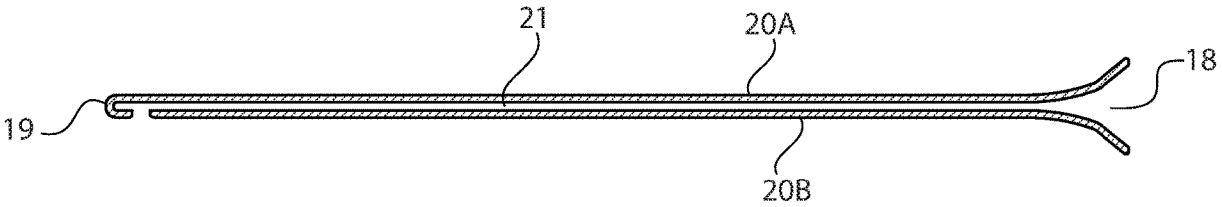
FIG. 7 is a cross-sectional view of the knife sheath of FIG. 5 taken along lines B-B, according to an implementation of the present principles.

Referring to FIGS. 1-3, there is generally shown the knife sheath with sharpener 10 according to the present principles. As will be described in more detail below, the knife sheath 12 has an open proximate end 18 for receiving a knife. The open end 18 includes a knife sharpener cartridge receiving slot 22 as a base of the opening 18. The knife sharpener cartridge receiving slot 22 is configured to receive and secure a sharpening cartridge 14 as shown. The cartridge 14 has sharpening elements 16 positioned therein such that the knife blade passes through the same as it enters and exits the open end 18 of sheath 12.

Figure 8:
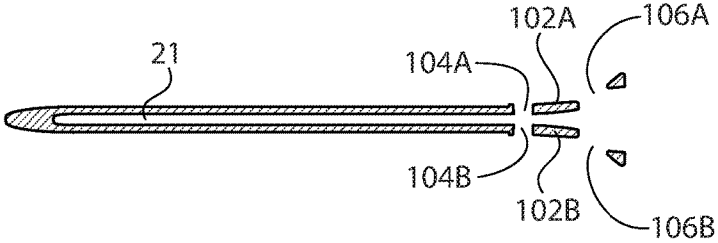
FIG. 8 is a cross-sectional view of the knife sheath of FIG. 5 taken along lines C-C, according to an implementation of the present principles.
Figure 9:
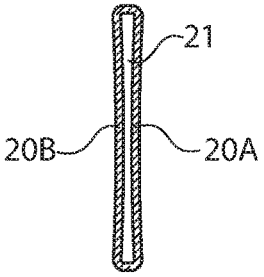
FIG. 9 is a cross-sectional view of the knife sheath of FIG. 5 taken along lines E-E, according to an implementation of the present principles.
Figure 10:
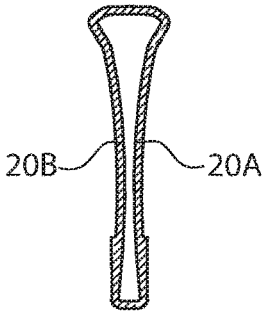
FIG. 10 is a cross-sectional view of the knife sheath of FIG. 5 taken along lines D-D, according to an implementation of the present principles.
Figure 11:
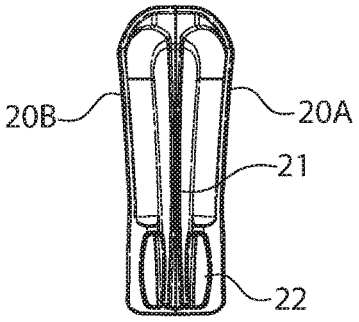
FIG. 11 is an end view of the knife sheath of FIG. 5 without the knife sharpening cartridge disposed therein, according to an implementation of the present principles.

FIGS. 5-11 show various views of the knife sheath 12 prior to the completion of the manufacturing/assembly (i.e., without the knife sharpening cartridge 14 positioned therein). As shown, the sheath 12 has two opposing sides 20A and 20B which form the sheath. The open end 18 receives the knife and includes the knife sharpener cartridge receiving slot 22 at the base thereof. FIGS. 7-11 show various cross sections of the sheath 12 showing the various configurations throughout the same. As can be seen in FIG. 8, and as described in more detail below with respect to FIG. 12, the sides 20 of the sheath are configured with opening configured to receive and secure the sharpening cartridge 14.

Figure 12:
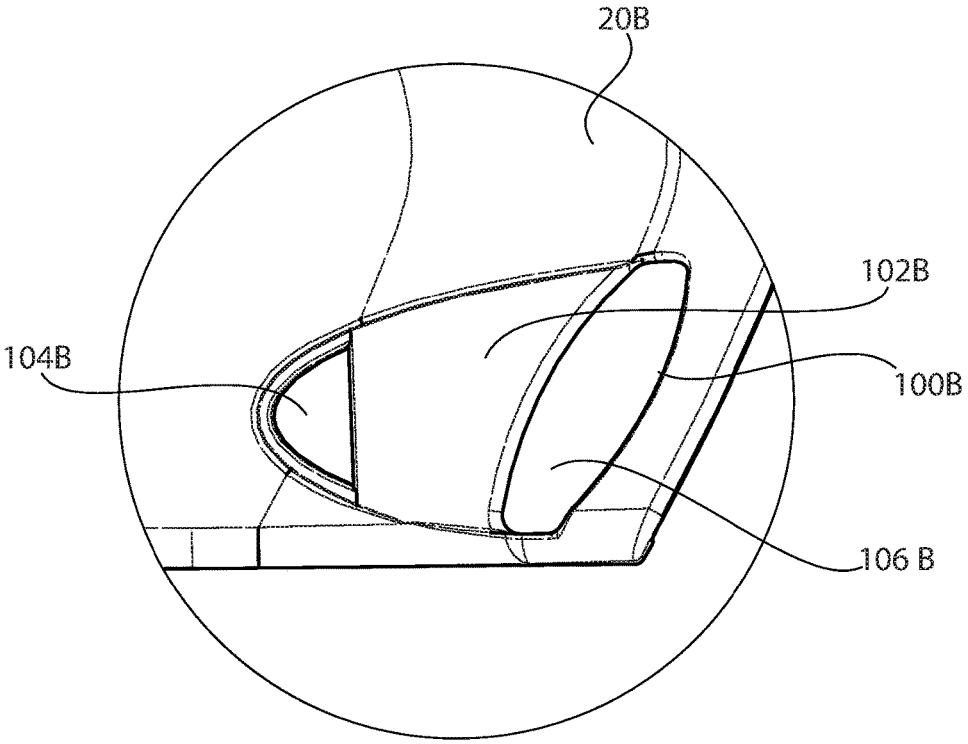
FIG. 12 is an enlarged view of the section F shown in FIG. 5, according to an implementation of the present principles.

FIG. 12 shows an enlarged portion of one side 20B of the manufactured sheath 12 configured for receiving and securing the knife sharpening cartridge 14. As shown, there is an opening 100B in the sheath that has a specific size and configuration to accommodate the receiving and release of the sharpening cartridge 14. A post 102B spans the opening 100B and as will be explained below, is used to secure the knife sharpening cartridge 14 into the sheath 12. The post 102B separates the opening 100B into two parts, a distal portion 104B and a proximal portion 106B, with a distal portion 104B being specifically configured in size and shape to receive the cartridge 14.

Figure 13G:
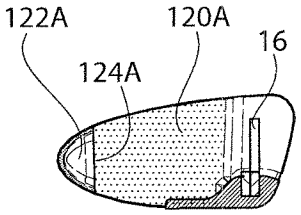
FIGS. 13A-13G show various view of the knife sharpening cartridge for a knife sheath, according to an implementation of the present principles.
Figure 13C:
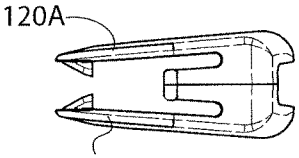
Figure 13D:
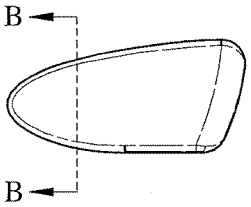
Figure 13E:
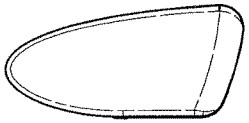
Figure 13F:
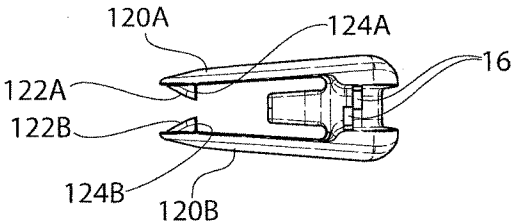
Figure 13B:
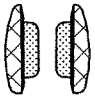
Figure 13A:
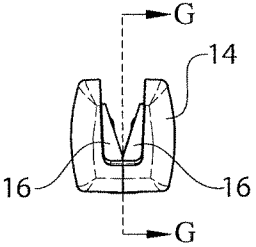
Figure 15:
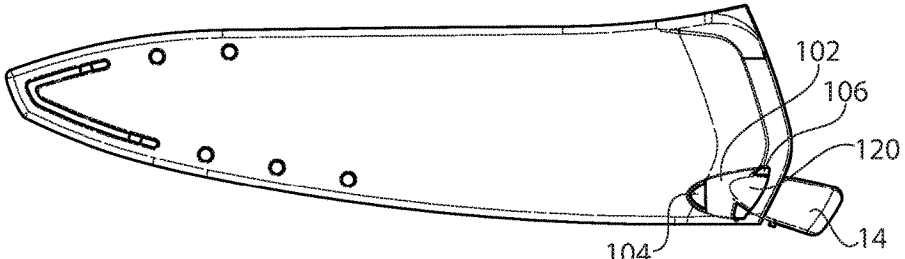
FIGS. 14-17 show the method for manufacturing the knife sharpening sheath, according to an implementation of the present principles.

FIGS. 13A-13G show the manufactured knife sharpening cartridge 14 according to an implementation of the present principles. FIG. 13A shows a front view of the knife sharpening cartridge with the sharpening elements 16 disposed therein. As shown, the cartridge 14 has a U-shape from this front view. Those of skill in the art will appreciate that the sharpening elements 16 work together to provide a specific sharpening angle to both sides of the sharp edge of the knife being inserted into the sheath. As such, it can be further appreciated that these sharpening elements can be changed or altered to accommodate any desired sharpening angle for the specific knife/sheath combination.

FIGS. 13F and 13C show the top and bottom views of the cartridge 14, respectively. Here is can be seen that the cartridge 14 has legs 120A and 120B that extend rearwardly (from the front thereof), and include angled clips 122A and 122B with flat snap surfaces 124A and 124B at the respective distal end of each leg. As will be described further below, the length of each leg 120 is configured such that the flat snap surfaces 124 "snap" over the post 102 to secure the cartridge 14 into its operable position.

Referring to FIGS. 14-17, there is shown the method steps by which the knife sheath is manufactured/assembled to provide the sharpening sheath of the present principles. As shown, once the two parts (i.e., the sheath 12 and the sharpening cartridge 14) are manufactured independently of each other, in the final assembly step, the sharpening cartridge 14 is snap fitted into the sheath 12.

Figure 16:
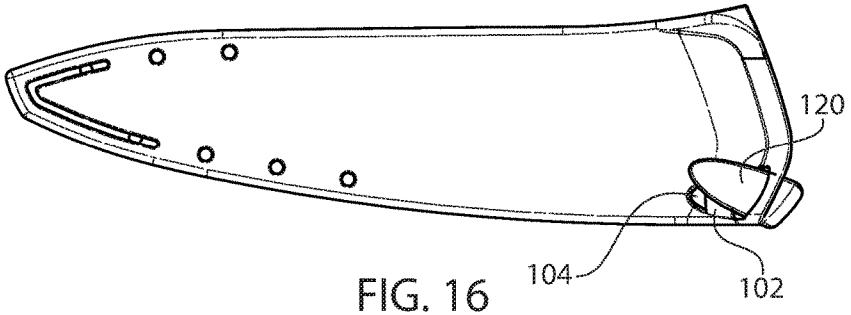
Figure 17:
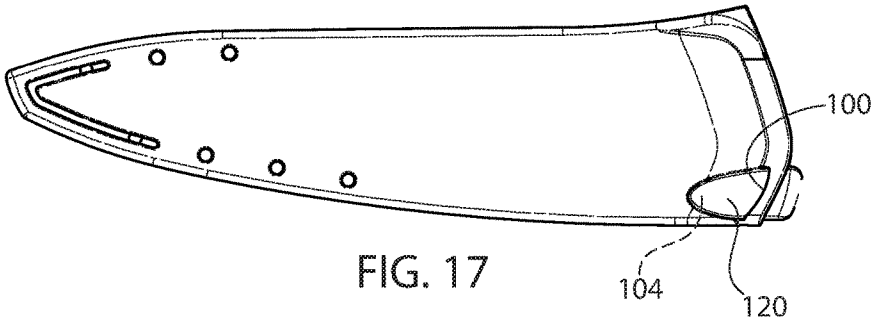
Figure 14:
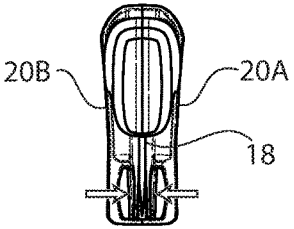

According to one implementation, the opening 18 of the sheath in the area where the cartridge 14 is received is squeezed such that the side walls 20A and 20B are moved closer to each other (see FIG. 14). Next, the legs 120 of the cartridge 14 are angled upward and inserted into the sheath opening 18 and then through the proximal part 106 of the cartridge opening 100 (See FIG. 15) such that the legs 120 are now positioned on the exterior of the post 102. The next step is to push the sharpening cartridge 14 until the flat the distal end angled clips 122 of the respective legs 120 completely pass over the exterior surface of the respective post 102 (FIG. 16). Finally, the flat snap surfaces 124 snap into the distal opening 104 which receives the entire angled clip 122 (FIG. 17). Once "snapped" in, the sharpening cartridge 14 is secured in place within the sheath and ready to be used.

According to one preferred embodiment, once the sharpening cartridge 14 is snap fitted into sheath 12, the assembly is completed and the cartridge cannot be removed from the sheath by the end user. According to another contemplated embodiment, the cartridge 14 and sheath 12 can be configured such that the cartridge can be removed and replaced by the end user.

Although the illustrative embodiments have been described herein with reference to the accompanying drawings, it is to be understood that the present principles is not limited to those precise embodiments, and that various changes and modifications may be effected therein by one of ordinary skill in the pertinent art without departing from the scope or spirit of the present principles. All such changes and modifications are intended to be included within the scope of the present principles as set forth in the appended claims.

What is claimed is:

1. A knife sheath comprising:

a first side;

a second side opposite said first side;

an open end formed by the two opposing sides, said open end configured to receive a knife into the sheath formed by the two opposing sides;

a first opening in first side;

a second opening in the second side opposite said first opening, each of said first and second openings having a post separating each of the first and second openings into a proximal portion and a distal portion; and a knife sharpening cartridge configured to extend through both of said proximal portions and secure to both of said posts to fix the knife sharpening cartridge to the opposing sides.

2. The knife sheath according to claim 1, wherein said knife sharpening cartridge comprises:

two opposing legs extending rearwardly from a front of the cartridge; and a locking mechanism positioned on distal ends of each of the two legs, said locking mechanism engaging said posts in said openings to secure the knife sharpening cartridge into the open end of the sheath.

3. The knife sheath according to claim 1, wherein the knife sharpening cartridge further comprises one or more sharpening elements.

4. The knife sheath according to claim 1, wherein the knife sharpening cartridge comprises:

two opposing legs extending rearwardly from a front of the cartridge; and angled clips positioned on distal ends of each of the two legs, said angled clips engaging said posts in said openings to secure the knife sharpening cartridge into the open end of the sheath.

5. The knife sheath according to claim 4, wherein said angled clips further comprise flat snap surfaces configured to snap over the posts and thereby secure the knife sharpening cartridge into an operable position within the open end of the sheath.

6. A knife sharpening sheath comprising:

two opposing sides;

an open end formed between the two opposing sides, said open end configured to receive a knife into the sheath formed by the two opposing sides;

two opposing openings, one in each of said two opposing sides, each of said opposing openings having a post separating each of the respective openings into a proximal portion and a distal portion; and a knife sharpening cartridge configured to extend through both of said proximal portions and secure to both of said posts to fix the knife sharpening cartridge to the opposing sides.

7. The knife sheath according to claim 6, wherein said knife sharpening cartridge comprises:

two opposing legs extending rearwardly from a front of the cartridge; and a locking mechanism positioned on distal ends of each of the two legs, said locking mechanism engaging said posts in said openings to secure the knife sharpening cartridge into the open end of the sheath.

8. The knife sheath according to claim 6, wherein the knife sharpening cartridge further comprises one or more sharpening elements.

9. The knife sheath according to claim 6, wherein the locking mechanism comprises angled clips positioned on distal ends of each of the two legs, said angled clips engaging said posts in said openings to secure the knife sharpening cartridge into the open end of the sheath.

10. The knife sheath according to claim 9, wherein said angled clips further comprise flat snap surfaces configured to snap over the posts and thereby secure the knife sharpening cartridge into an operable position within the open end of the sheath.

* * * * *